US008168871B1

(12) United States Patent
Sweedler

(10) Patent No.: US 8,168,871 B1
(45) Date of Patent: May 1, 2012

(54) BOW ATTACHMENT

(76) Inventor: Kristin G. Sweedler, Annapolis, MD (US)

( * ) Notice: Subject to any disclaimer, the term of this patent is extended or adjusted under 35 U.S.C. 154(b) by 8 days.

(21) Appl. No.: 12/963,319

(22) Filed: Dec. 8, 2010

(51) Int. Cl.
*G10D 1/02* (2006.01)

(52) U.S. Cl. ..... 84/282

(58) Field of Classification Search ..... 84/282
See application file for complete search history.

(56) References Cited

U.S. PATENT DOCUMENTS

| | | | | |
|---|---|---|---|---|
| 1,673,996 | A | 3/1926 | Rathsach | |
| 2,820,388 | A | 1/1958 | Rolland | |
| 3,656,187 | A * | 4/1972 | Katz | 623/65 |
| 6,777,600 | B2 | 8/2004 | Daring | |

* cited by examiner

*Primary Examiner* — Jianchun Qin

(74) *Attorney, Agent, or Firm* — The Law Firm of Andrea Hence Evans, LLC

(57) ABSTRACT

A bow attachment device attaches to the end of a bow to compensate for a smaller or under-developed digit. The bow attachment device provides a block that attaches to the bow in a manner allowing the stick of the bow to slide through the block. A leg on the block provides a ledge that extends outward from the block allowing the digit to rest on the ledge and be elevated higher than other digits. The device creates an extension between the bow stick and the smaller digit allowing the digit to participate in subtle manipulation of the bow.

9 Claims, 8 Drawing Sheets

BOW ATTACHMENT

FIELD OF THE INVENTION

The present invention relates in general to a device that attaches to the end of a bow to compensate for a smaller or under-developed finger.

BACKGROUND OF THE INVENTION

Stringed instruments such as the violin, cello, or viola require the user's ability to properly hold the bow. Typically the bow is held in a down stroke position or an up stroke position. The musician's fingers are quite arched in the standard down stroke position. The thumb is slightly bent. The musician's fingers are slightly more elongated in an upstroke position. Relaxed fluid movement in the arm, wrist and hand are necessary to master the instrument. Proper positioning of the fingers aid in obtaining the proper manipulation of the bow. Improper positioning of the fingers causes the musician to work harder to hold the bow and may even cause the musician to lose interest in playing a stringed instrument.

SUMMARY OF THE INVENTION

This invention introduces a device that attaches to the end of a bow to compensate for a smaller or under-developed digit.

An aspect of an embodiment of the invention provides a block structure that attaches to the bow in a manner allowing the stick of the bow to slide through the block structure.

A further aspect of an embodiment of the invention provides a ledge that extends from the block allowing the digit to rest on the ledge.

A further aspect of an embodiment of the invention creates an extension between the bow stick and the smaller digit allowing the digit to participate in subtle manipulation of the bow.

Additional aspects, objectives, features and advantages of the present invention will become apparent from the following description of the preferred embodiments with reference to the attached drawings.

DETAILED DESCRIPTION OF THE INVENTION

Figure 1:
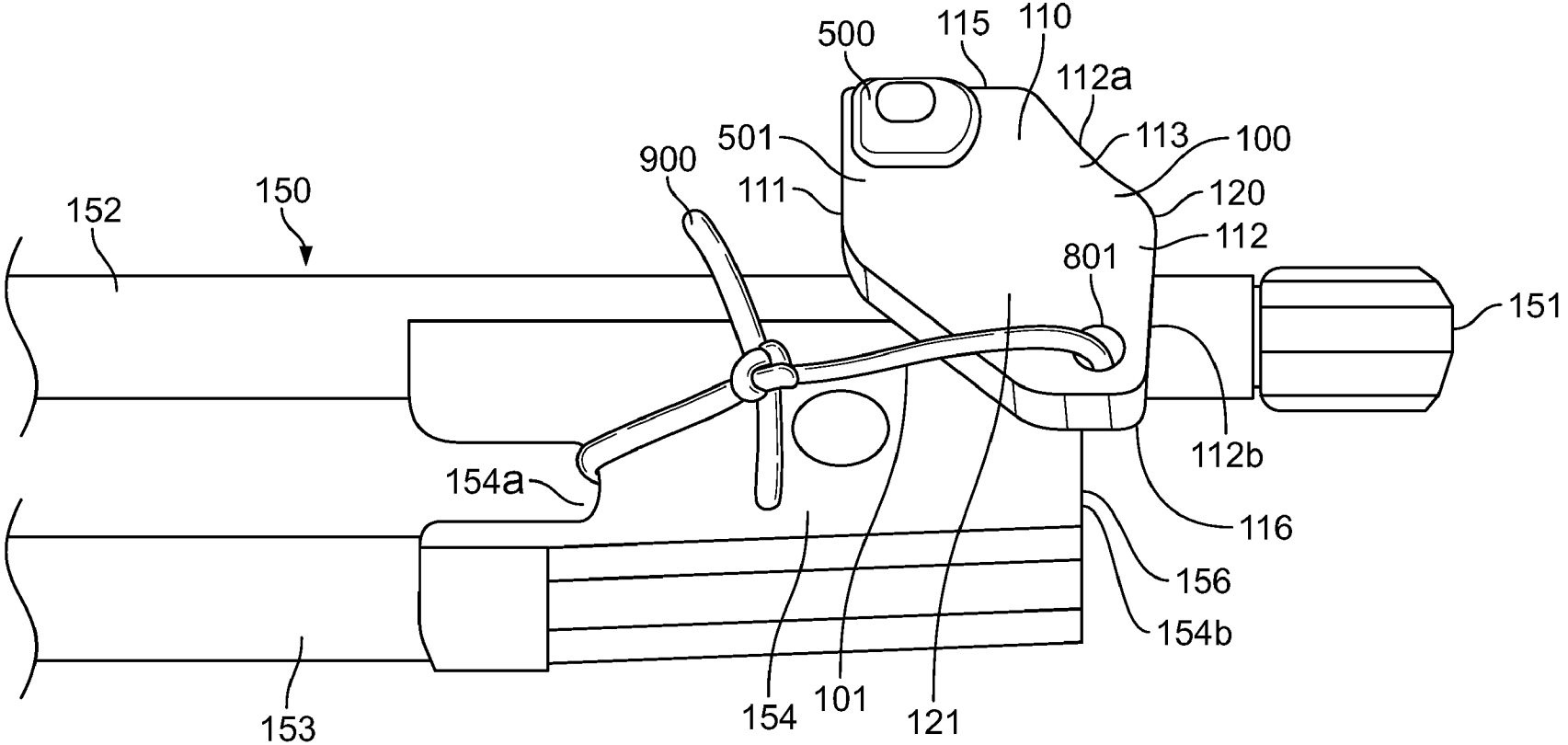
FIG. 1 is a perspective view of the bow attachment device with a tie-style fastener on a bow.
Figure 9:
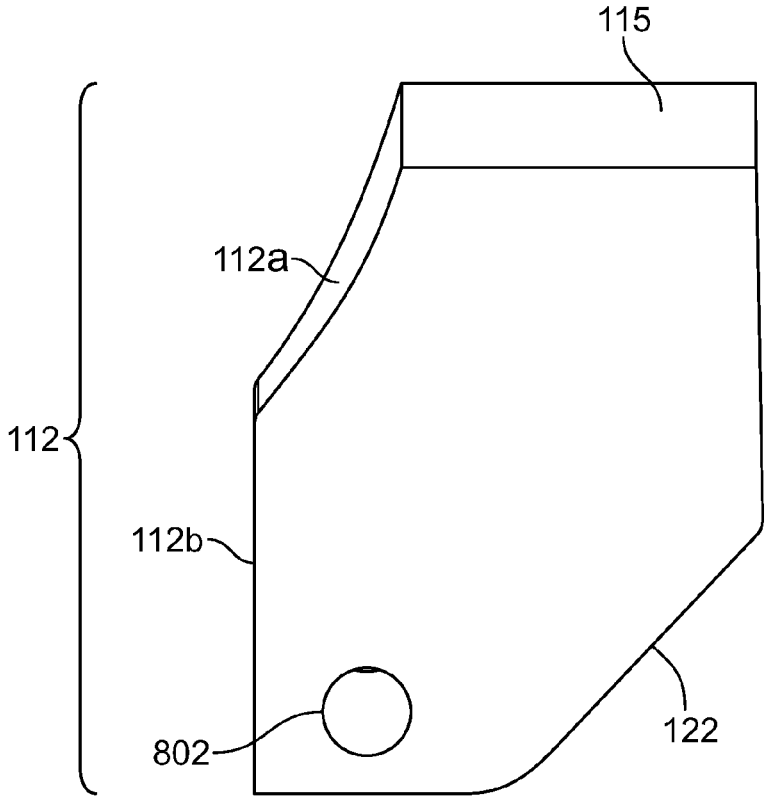
FIG. 9 is a right side view of the bow attachment device.

FIG. 1 is a perspective view of the bow attachment device 100 with a tie-style fastener 101 on a bow 150. The bow 150 features a screw 151, stick 152, hair 153 and a frog 154. The vast majority of bows are used with string instruments, although some bows are used with musical saws and other bowed idiophones. The frog 154 has a front part 154*a* and back part 154*b*. The bow attachment device 100 features a block structure 110 having a front 111, back 112, left 113, right 114, top 115 and bottom side 116. The bow device 100 may be made from ebony but other materials, often decorative, may be used as well. These materials may include ivory and tortoiseshell. The block 110 can be carved or cast in a hard, lightweight material such as hard plastic or vinyl for example. The front 111 of the block 110 is somewhat curved and meets the bottom 116 of the block 110 to form an obtuse angle. The back side 112 has a first plane 112*a* and a second plane 112*b* that meet to form an angle 120. The second plane 112*b* is parallel to the back wall 156 on the frog 154 when the device 100 is positioned on the bow 150. The left side 113 of the block 110 is the side that faces the user when the bow 150 is held. The right side 114 is opposite the left side 113. Both the left 113 and right side 114 have identical shapes. The left side 113 is a first leg 121 extending from the top 115 of the block structure 110. The right side 114 is a second leg 122 extending from the top 115 of the block structure 110. FIG. 9 is a right side view of the bow attachment device illustrating leg 122. The second plane 112*b* has an opening 700 sized to receive the stick 152 and screw 151. The opening 700 is a somewhat circular shape. The opening 700 opens to the inside 710 of the block 110. The inside 710 of the block 110 is underneath the block 110. The opening 700 opens into a channel 720 inside the block 150 such that the channel 720 allows the block 150 to rest on the back portion 154*b* of the frog 154. The channel 720 is the space inside 710 the block 110 between the first and second legs 121,122 and below the top 115 of the block 110.

Figure 3:
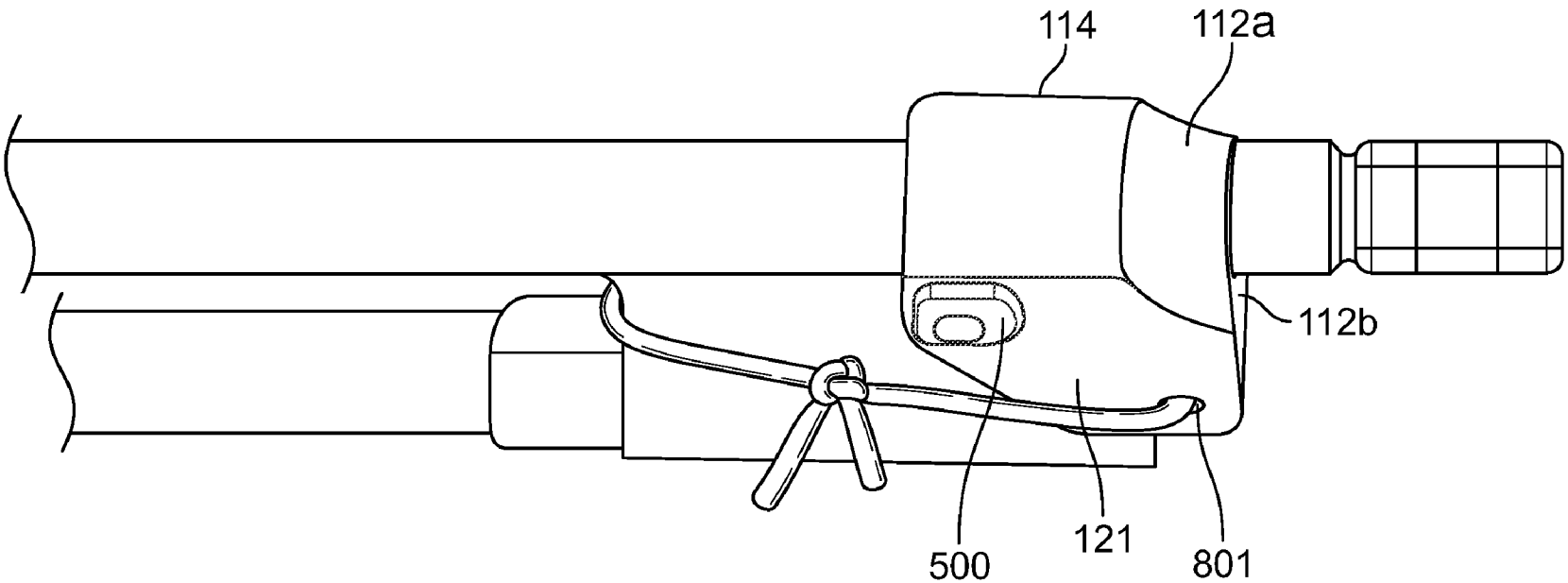
FIG. 3 is a top view of the bow attachment device on a bow.
Figure 5:
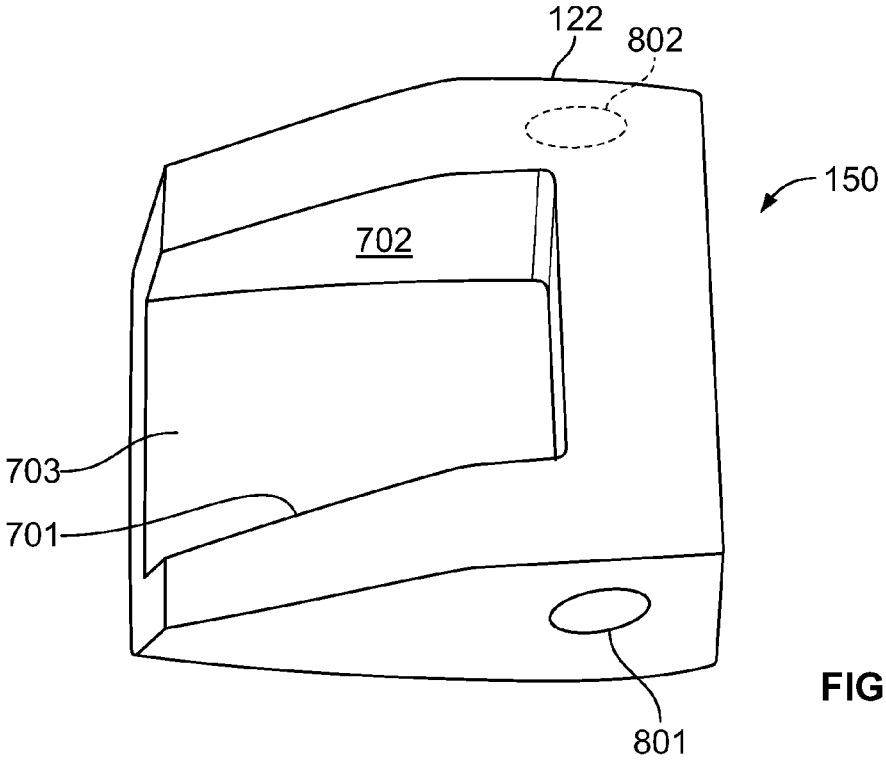
FIG. 5 is an illustration of the device on its first leg.
Figure 6:
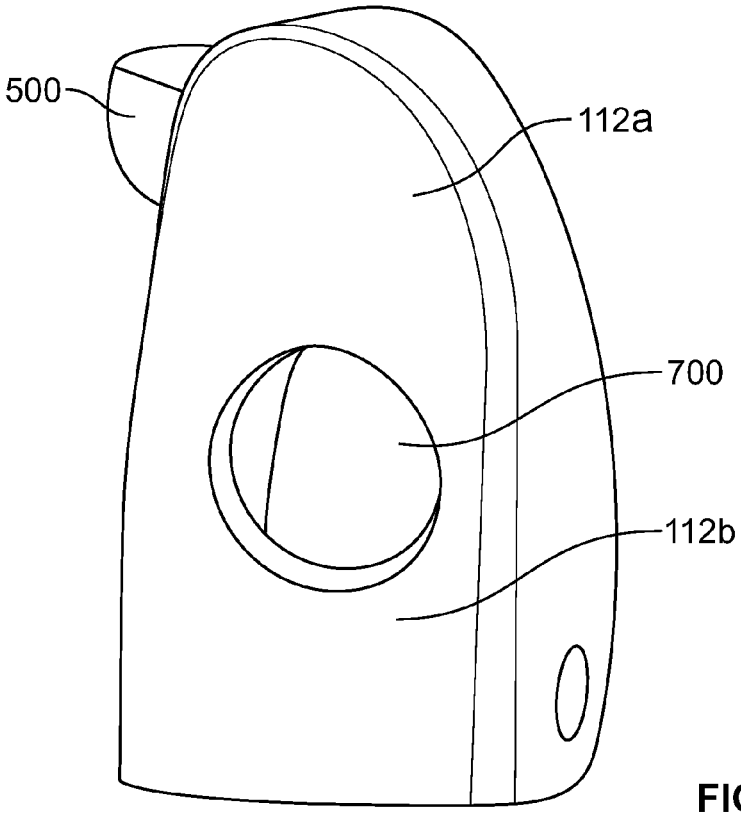
FIG. 6 is a back view of the bow attachment device.
Figure 7:
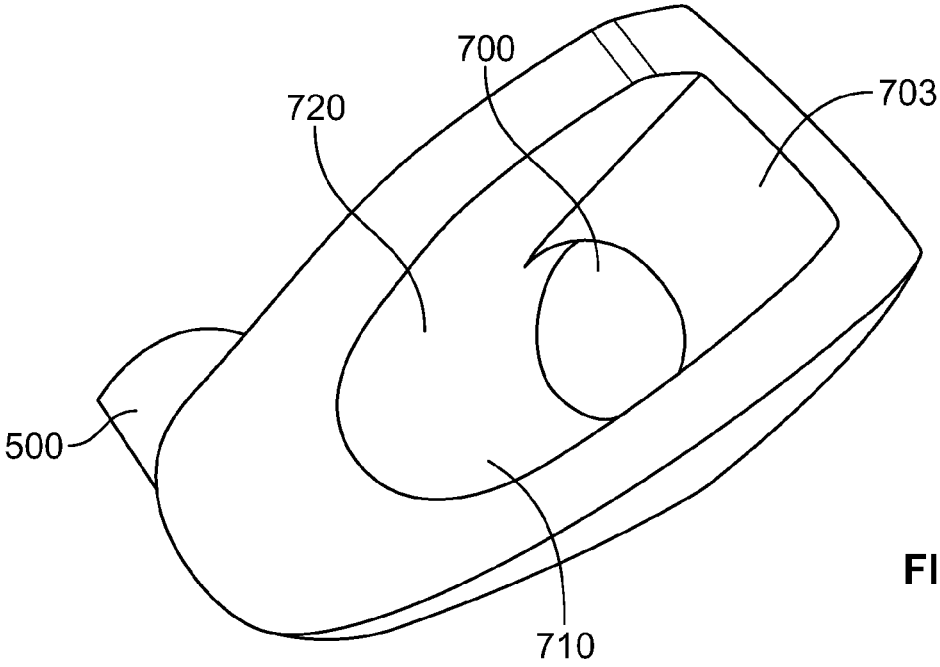
FIG. 7 is an inside view of the bow attachment device.

The bow 150 and screw 151 are inserted through the opening 700. The device 100 is slid onto the bow 150 until the frog back portion 154 abuts the left and right inside walls 701, 702 of the legs 121, 122 and the back inside wall 703, as shown in FIG. 7. The device 100 rests slightly above the bottom of the frog 154 so that the connecting holes 801, 802 are somewhat aligned with the front part 154*a* of the frog 154. The first and second leg 121, 122 features a first and second connecting hole 801, 802, respectively. FIG. 5 is an illustration of the device on its first leg 121. The connecting holes 801, 802 diameters are smaller than the opening 700 on the back 112 of the block 110. The holes 801, 802 are positioned in identical locations on each leg 121, 121 such that they are aligned with each other on their respective legs. FIG. 3 is a top view of the bow attachment device 100 on a bow 150. FIG. 3 illustrates the connecting hole 801 on the first leg 121. FIG. 6 is a back view of the bow attachment device 100.

Figure 2:
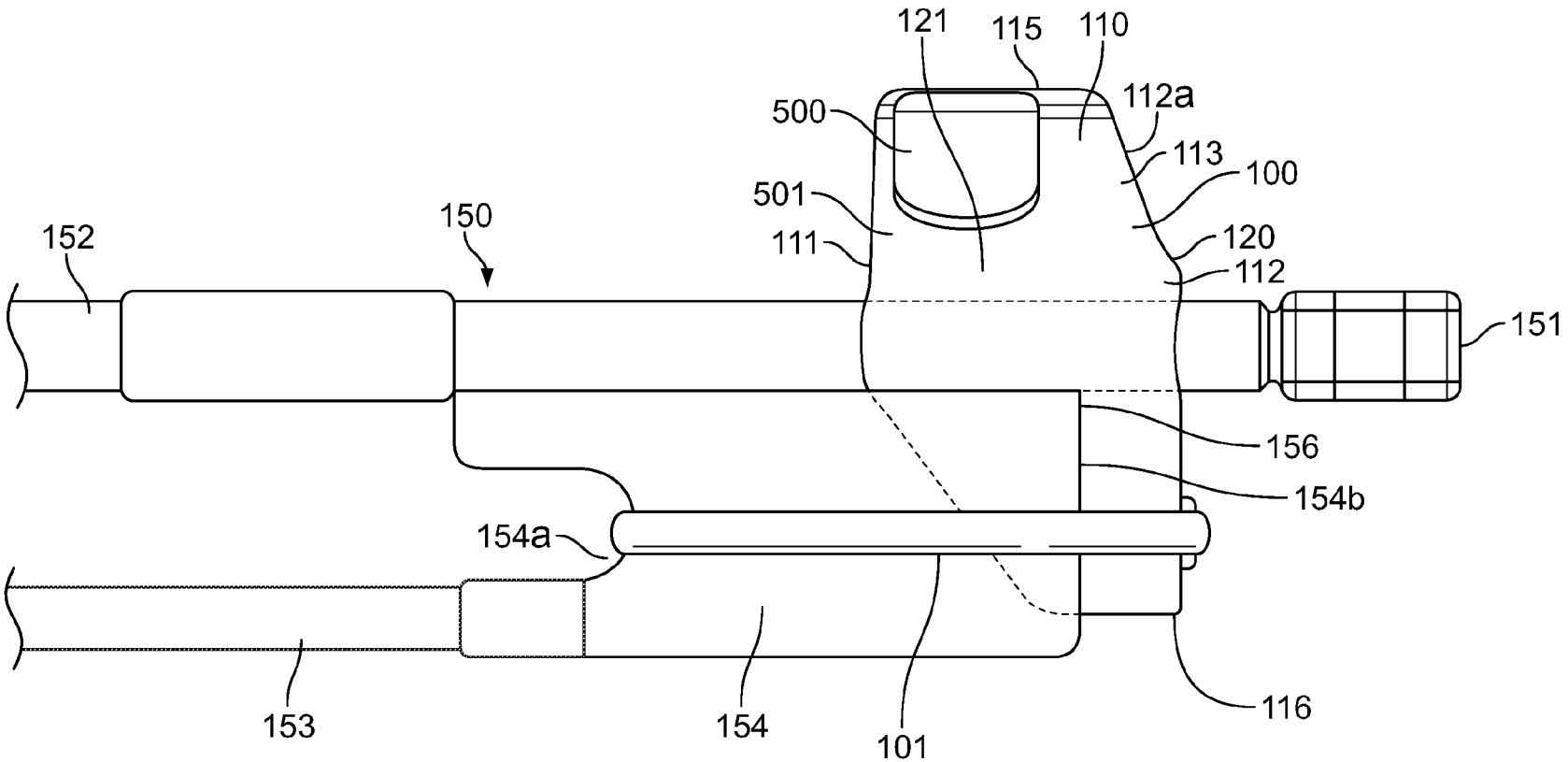
FIG. 2 is a transparent perspective view of the bow attachment device with a strap-style fastener on a bow.

The holes 801, 802 are positioned behind where the frog 154 abuts the inside walls 701, 702 so that a fastener 900 can extend through the holes 801, 802 and around the front 154*a* of the frog 154 to secure the device 100 to the bow 150 and the fastener does not interfere with the frog 154 abutting the inside walls 701, 702, 703 of the device. The fastener 900 may form a loop and the ends may mate together or be tied together, as shown in FIG. 1. Alternatively, the fastener 900 may be in the form of a band or strap that is received around the front part 154*a* of the frog 154. FIG. 2 is a transparent perspective view of the bow attachment device 100 with a strap-style fastener 900 on a bow 150.

Figure 8:
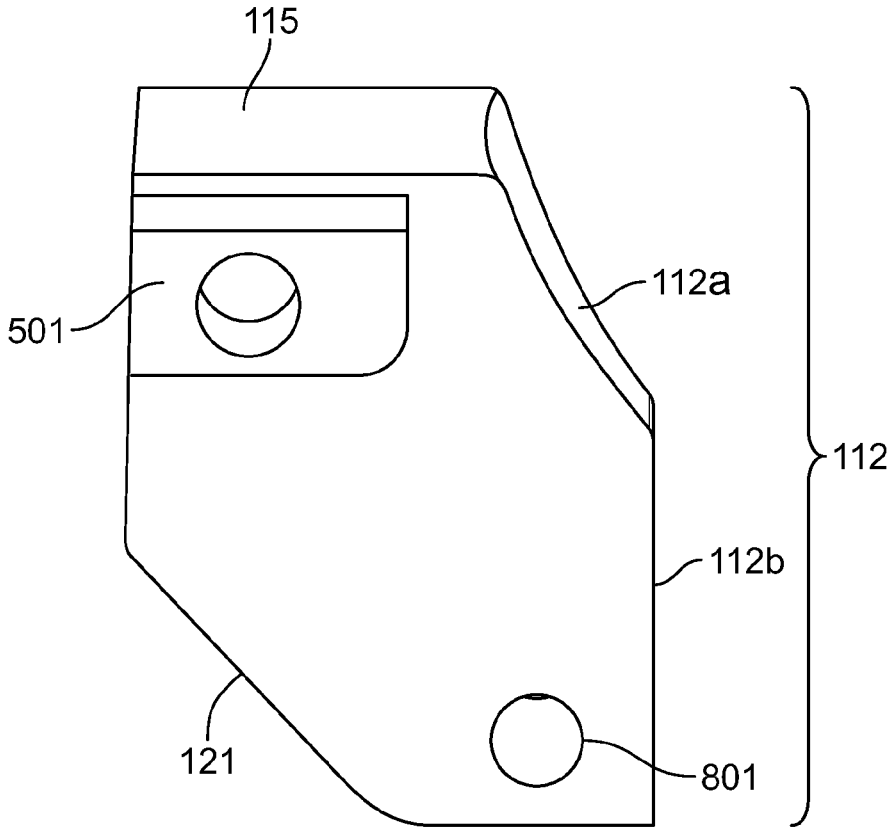
FIG. 8 is a left side view of the bow attachment device.

The first leg 121 features a platform 500 on the leg 121. FIG. 8 is a left side view of the bow attachment device 100 showing the first leg 121.

Figure 4:
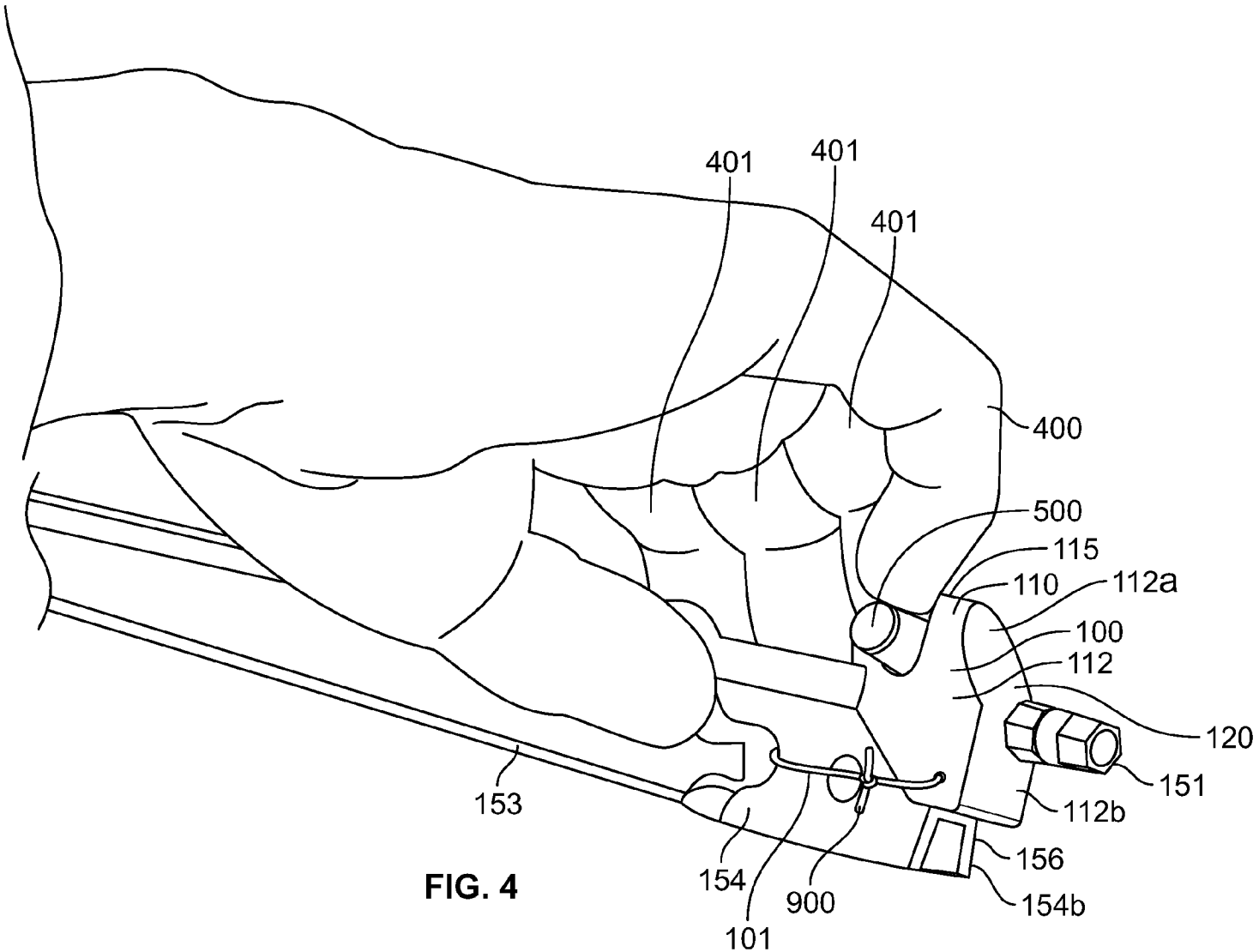
FIG. 4 is a perspective view of the bow attachment device on a bow in use.

The platform structure 500 acts a ledge located substantially near a top portion 501 of the first leg 121 and extending outwardly from the first leg 121 such that a fourth finger 400 may be elevated when it sits on the ledge, as shown in FIG. 4. FIG. 4 is a perspective view of the bow attachment device 100 on a bow 150 in use. The device 100 is in use when a user handles the bow 150. The ledge 500 lifts the fourth finger 400 above other fingers 401 on the bow 150.

Figure 10:
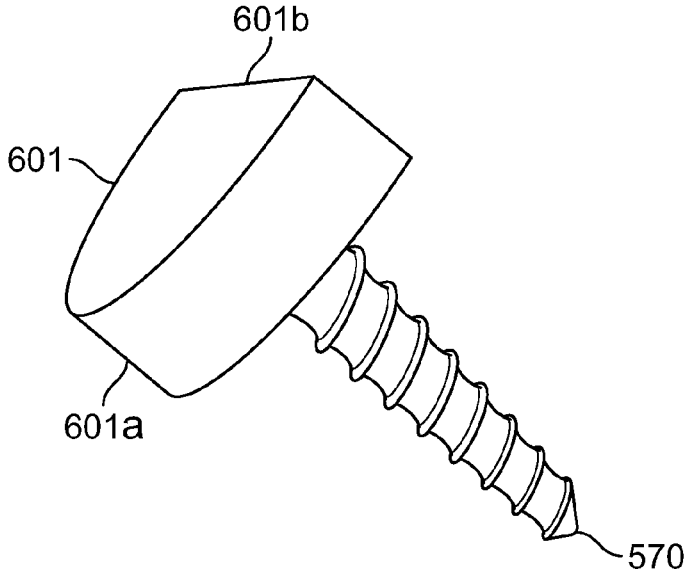
FIG. 10 is a perspective view of the platform structure.
Figure 11:
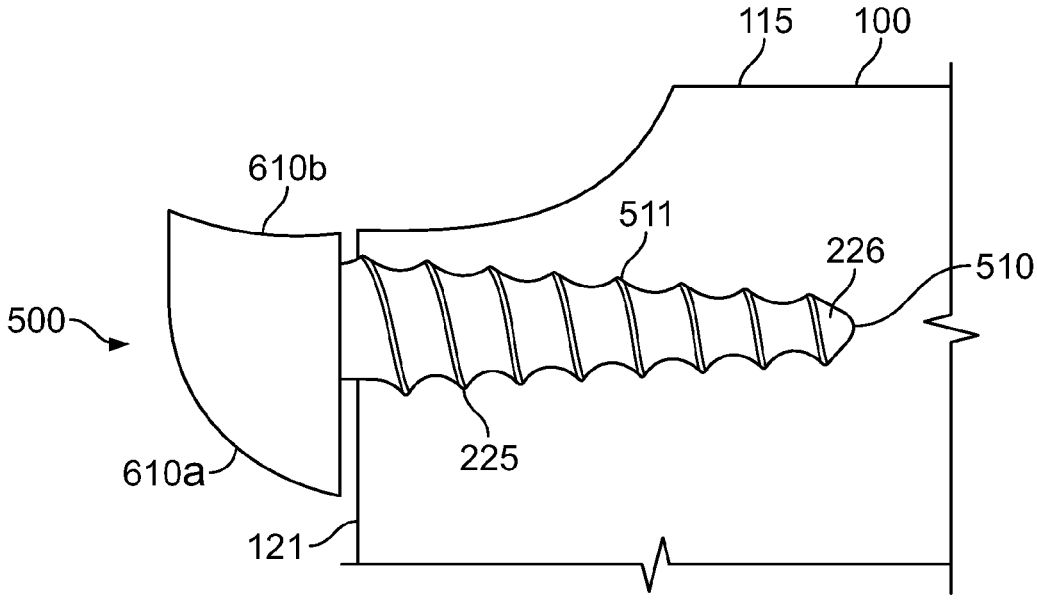
FIG. 11 is a perspective view of the platform structure attached to the device.
Figure 12:
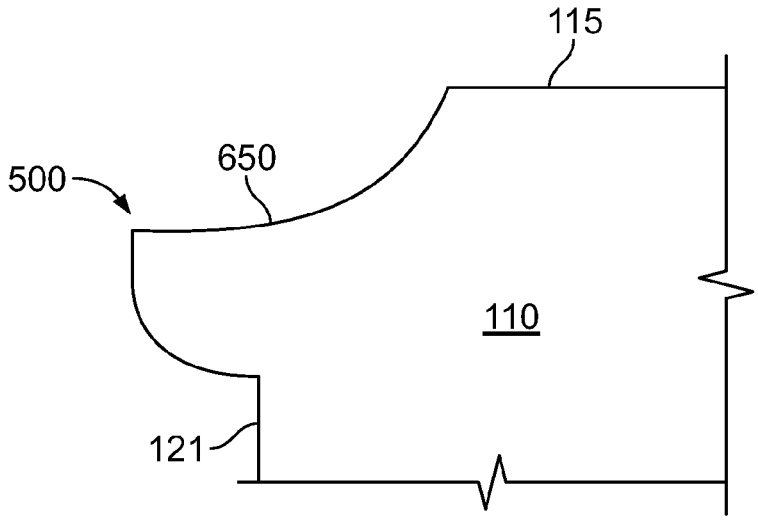
FIG. 12 is a perspective view of an embodiment of the device with a unitary platform structure.

FIG. 10 is a perspective view of the platform structure 500. The platform structure 500 is a ledge having a semi-circular body 601 with a rounded bottom 601*a* and a flat top 601*b*. Additional body shapes such as square, rectangular or any polygonal shape can be used for the shape of the structure 500. The fourth finger 400 contacts the flat top 601*b* when the device 100 is in use. The platform structure 500 is sized such that only the fourth finger 400 rests on the top 601*b* when the bow 150 is handled properly. When handled properly, only the fourth finger 400 is positioned such that it is supported by the platform structure 500. The fourth finger 400 is elevated higher than all the other fingers when it is positioned on the structure 500. FIG. 11 is a perspective view of the platform structure 500 attached to the device 100. The block 110 can have an opening 225 on the first leg 121 having block threads 226 that receive the platform 500. The platform 500 can have a platform extension 510 which have platform threads 511 that mate with the block threads 226. In this embodiment, the platform 500 can be screwed to the first leg 121. Alternatively, the platform extension 510 may be glued or fitted inside the platform threads 511 without screwing. Alternatively, the platform structure 500 may not require an extension 510 and the structure may be attached to the device 100 by known attachment methods. FIG. 12 is a perspective view of an embodiment of the device with a unitary platform structure 500. Rather than attaching the structure to the device, the structure 500 can be formed so that the structure has a top 650 that extends outward on the first leg 121. The top 650 is an extension of the top 115 of the device and dips downward so that the finger 400 can rest on the top 650 and be elevated about the other fingers on the bow.

If the bow stick is narrow so that the attachment slides on the bow, a piece of material can be positioned inside the space between the legs of the device and the frog to help fit the attachment snuggly to the bow.

The platform structure 500 allows a user with an underdeveloped or smaller fourth finger 400 to arch the finger 400 for adequate handling and manipulation of the bow 150. The device 100 creates an extension between the bow stick 140 and the smaller digit 400.

The invention has been described in detail with particular reference to certain preferred embodiments thereof, but it will be understood that variations and modifications can be effected within the spirit and scope of the invention.

The invention claimed is:

1. A bow attachment device for a bow having a stick and a frog, the frog having a front frog part and a back frog part, the device comprising:

a block structure having a front, back, left, right, top and bottom side, a first and second leg extending from the top of the block structure, wherein the first and second leg comprise a first and second connecting hole, respectively;

a fastener extending through the first and second hole and around the front frog part to secure the device to the bow; and a platform on the first leg, wherein the platform is a ledge substantially near a top portion of the first leg and extending outwardly from the first leg such that a fourth finger is elevated when it sits on the ledge;

wherein the block structure comprises an opening on the first leg having block threads that receive the platform, wherein the platform has platform threads that mate with the block threads.

2. The bow attachment device of claim 1, wherein the opening opens into a channel inside the block such that the channel allows the block to rest on the back portion of the frog.

3. The bow attachment device of claim 1, wherein the first and second hole are aligned with each other on their respective legs.

4. The bow attachment device of claim 1, wherein the fastener is a band.

5. A bow attachment device for a bow having a stick and a frog, the device comprising:

a block structure having a back side and a first and second leg, wherein the first and second leg comprise a first and second connecting hole, respectively;

wherein the back side comprises an opening that receive the stick and opens into a channel inside the block sized to allow the inside of the block to rest on the frog;

a platform on the first leg, wherein the platform is a ledge substantially near a top portion of the first leg and extending outwardly from the first leg;

wherein the ledge comprises a body with a substantially flat top;

wherein the block structure further comprises an opening on the first leg having block threads that receive the platform, wherein the platform has platform threads that mate with the block threads.

6. The bow attachment device of claim 5 further comprising a fastener extending through the first and second connecting hole and around the frog to secure the device to the bow.

7. The bow attachment device of claim 5, wherein the channel is the space inside the block between the first and second legs and below the top of the block.

8. A method of handling a bow comprising:

providing a bow having a stick, screw and a frog;

providing a bow attachment device comprising a block structure having a back side and a first and second leg, wherein the first and second leg comprise a first and second connecting hole, respectively;

providing an opening on the back side;

providing a platform on the first leg, wherein the platform is a ledge substantially near a top portion of the first leg and extending outwardly from the first leg;

wherein the block structure comprises an opening on the first leg having block threads that receive the platform, wherein the platform has platform threads that mate with the block threads;

providing a channel inside the block;

inserting the screw of the bow through the opening on the back side of the block until the channel receives the frog;

extending a fastener through the first and second connecting holes and around the frog to secure the device to the bow.

9. The method of handling the bow of claim 8 further comprising: manipulating the bow such that a fourth finger is elevated above other fingers when the fourth finger sits on the ledge.

* * * * *